US010337172B2

(12) United States Patent
Lee et al.

(10) Patent No.: US 10,337,172 B2
(45) Date of Patent: Jul. 2, 2019

(54) HYDRAULIC CONTROL SYSTEM

(71) Applicant: VOLVO CONSTRUCTION EQUIPMENT AB, Eskilstuna (SE)

(72) Inventors: Sang Hee Lee, Gyeongsangnam-do (KR); Eun Byeol Lee, Gyeongsangnam-do (KR)

(73) Assignee: Volvo Construction Equipment AB, Eskilstuna (SE)

( * ) Notice: Subject to any disclaimer, the term of this patent is extended or adjusted under 35 U.S.C. 154(b) by 0 days.

(21) Appl. No.: 15/544,078

(22) PCT Filed: Jan. 27, 2015

(86) PCT No.: PCT/KR2015/000822
§ 371 (c)(1),
(2) Date: Jul. 17, 2017

(87) PCT Pub. No.: WO2016/122010
PCT Pub. Date: Aug. 4, 2016

(65) Prior Publication Data

US 2018/0002898 A1 Jan. 4, 2018

(51) Int. Cl.
*E02F 9/22* (2006.01)
*E02F 9/20* (2006.01)
(Continued)

(52) U.S. Cl.
CPC ..... *E02F 9/2267* (2013.01); *E02F 9/20* (2013.01); *E02F 9/22* (2013.01); *E02F 9/2235* (2013.01);
(Continued)

(58) Field of Classification Search
CPC ..... E02F 9/2267; E02F 9/2285; E02F 9/2296; E02F 9/2235; F15B 11/0423;
(Continued)

(56) References Cited

U.S. PATENT DOCUMENTS 6,575,076 B1 * 6/2003 Achten ..... F04B 1/2042 60/419
6,615,114 B1 * 9/2003 Skiba ..... E02F 9/2025 172/2
(Continued)

FOREIGN PATENT DOCUMENTS

EP 0504415 A1 9/1992
EP 2587074 A1 5/2013
(Continued)

OTHER PUBLICATIONS

International Search Report (dated Sep. 23, 2015) for corresponding International App. PCT/KR2015/000822.
(Continued)

*Primary Examiner* — Mark A Laurenzi
*Assistant Examiner* — Shafiq Mian
(74) *Attorney, Agent, or Firm* — WRB-IP LLP

(57) ABSTRACT

A hydraulic control system includes a flow rate control valve; a variable displacement hydraulic pump which is connected to the flow rate control valve and discharges hydraulic pressure to the flow rate control valve; a pump discharge pressure detector which is installed in a section where the flow rate control valve and the variable displacement hydraulic pump are connected, and detects the discharge pressure of the hydraulic pressure discharged from the variable displacement hydraulic pump to the flow rate control valve; and a hydraulic controller including a detection unit which is connected to the pump discharge pressure detector, detects the discharge pressure of the variable displacement hydraulic pump and converts the discharge pressure to a pump discharge pressure value, a comparison unit which receives the pump discharge pressure value from the detection unit, compares the pump discharge pressure value with a pre-stored lowest recognition pressure value, and determines whether the pump discharge pressure value
(Continued)

is greater or less than the lowest recognition pressure value, and a calculation unit which, by interworking with the comparison unit, if the pump discharge pressure value is less than the lowest recognition pressure value, calculates a control pressure by recognizing the control.

6 Claims, 8 Drawing Sheets

(51) Int. Cl.
*F15B 11/02* (2006.01)
*F15B 11/042* (2006.01)

(52) U.S. Cl.
CPC ..... *E02F 9/2285* (2013.01); *E02F 9/2296* (2013.01); *F15B 11/02* (2013.01); *F15B 11/0423* (2013.01); *F15B 2211/20546* (2013.01); *F15B 2211/6316* (2013.01); *F15B 2211/6654* (2013.01)

(58) Field of Classification Search
CPC .... F15B 2211/20546; F15B 2211/6316; F15B 2211/6654
See application file for complete search history.

(56) References Cited

U.S. PATENT DOCUMENTS

| | | | | |
|---|---|---|---|---|
| 7,234,298 | B2 * | 6/2007 | Brinkman | E02F 9/2217 60/414 |
| 7,775,040 | B2 * | 8/2010 | Khalil | F15B 11/024 60/414 |
| 7,908,852 | B2 * | 3/2011 | Zhang | E02F 9/2217 60/414 |
| 9,022,749 | B2 * | 5/2015 | Akiyama | E02F 9/123 417/212 |
| 9,963,855 | B2 * | 5/2018 | Jagoda | B60K 6/12 |
| 2008/0104953 | A1 * | 5/2008 | Vigholm | E02F 9/2217 60/413 |
| 2011/0020146 | A1 * | 1/2011 | Akiyama | E02F 9/123 417/213 |
| 2013/0098021 | A1 * | 4/2013 | Shin | E02F 9/2235 60/328 |
| 2015/0075148 | A1 * | 3/2015 | Yamaji | F04B 49/06 60/420 |

FOREIGN PATENT DOCUMENTS

| | | | |
|---|---|---|---|
| JP | 2011153572 | A | 8/2011 |
| KR | 100641393 | A | 6/2006 |
| KR | 101189632 | A | 11/2010 |
| KR | 20110077061 | A | 7/2011 |
| KR | 20140093657 | A | 7/2014 |

OTHER PUBLICATIONS

European Official Action (dated Oct. 16, 2018) for corresponding European App. EP 15 88 0192.

* cited by examiner

HYDRAULIC CONTROL SYSTEM

BACKGROUND AND SUMMARY

The present disclosure relates to a hydraulic control system. More particularly, the present disclosure relates to a positive hydraulic control system for preventing a working device from abnormally shaking, for example, hunting oscillations, wherein a lowest recognition pressure value is pre-stored in a database, a pump discharge pressure value is measured, when the measured pump discharge pressure value is lower than the lowest recognition pressure value, a control pressure is recognized as having the pre-stored lowest recognition pressure value, and when the measured pump discharge pressure value is greater than the lowest recognition pressure value, the control pressure is recognized as having the measured pump discharge pressure value.

Apparatuses using hydraulic pressure, such as construction machinery, are designed to obtain optimal output characteristics by matching the input horsepower of a pump to the output horsepower of an engine.

Generally, the hydraulic control systems of construction machinery are designed to perform constant-horsepower control to prevent an engine, a pump, a pipeline, a cylinder, or the like from being subjected to an excessive amount of pressure during high-load operations, so that the pipeline or an actuator is not fractured or the engine or the pump is not damaged.

Technological features related to constant-horsepower control will be described with reference to FIGS. 1 to 3 hereinafter. FIG. 1 is a block diagram illustrating a general constant-horsepower control system, FIG. 2 is a graph illustrating a relationship between pilot pressure and pump displacement preset in a hydraulic controller illustrated in FIG. 1, and FIG. 3 shows a pump constant torque curve preset in the hydraulic controller illustrated in FIG. 1, i.e. a graph depicting constant horsepower control through adjustment of the pump displacement and pump torque depending on discharge pressures of a variable displacement hydraulic pump.

As illustrated in FIG. 1, the hydraulic control system performing constant-horsepower control includes a control lever 1, a pressure sensor 2, a flow control valve 3, pump discharge pressure detectors 4, a hydraulic controller 5, variable displacement hydraulic pumps 6, electro-proportional pressure reducing valves 7, and an engine 8.

Describing an operation of the system for constant-horsepower control, the pressure sensor 2 detects a pilot pressure output by the control lever 1 and delivers a detected pressure value to the hydraulic controller 5.

Then, as illustrated in FIG. 2, the hydraulic controller 5 performs an operation of opening or closing an electro-proportional pressure reducing valve 7 by sending an electronic signal to the electro-proportional pressure reducing valve 7 to change displacement of the variable displacement hydraulic pump 6 in accordance with the curve of preset pump displacements with respect to pilot pressures.

The hydraulic controller 5 adjusts pump displacement depending on pilot pressure as illustrated in the pump volume curve of FIG. 2, as long as the variable displacement hydraulic pump operates within a preset maximum allowable torque value in the pump constant torque curve illustrated in FIG. 3. This prevents the engine 8 and the system from being damaged during high load operations, thereby protecting the engine 8 and the system.

FIG. 4 is a graph illustrating the pilot pressure of the control lever 1, the discharge pressure of a variable displacement hydraulic pump 6, and a control signal by which the hydraulic controller 5 instructs the variable displacement hydraulic pumps 6, plotted with time.

In a low temperature environment, for example, in the middle of the winter, since the viscosity of hydraulic fluid is increased, the pressure may abruptly change in a specific operation during hydraulic control. If such an abrupt change occurs when a pump discharge pressure P1 or P2 of the variable displacement hydraulic pump 6 is passing a pressure value at which the constant horsepower control, as illustrated in FIG. 3, is started, the hydraulic controller 5 transmits a control signal for increasing or reducing the displacement of the variable displacement hydraulic pump 6 accordingly, to the electro-proportional pressure reducing valves 7, so that constant horsepower is maintained.

However, there is a minute time difference between a point in time at which the pressure of the pump is abruptly changed and a point in time at which the displacement of the variable displacement hydraulic pump 6 is actually changed in response to the control signal transmitted to the electro-proportional pressure reducing valve 7 by the hydraulic controller 5. Thus, when an abrupt pressure change occurs at a low temperature, such a method of controlling the displacement of the variable displacement hydraulic pump 6 may lead to resonance, such that the pump discharge pressure vibrates, as illustrated in FIG. 4. Consequently, the hydraulic working devices are subjected to hunting oscillations, abrupt shaking, which is problematic.

Accordingly, an aspect of the present disclosure has been made in consideration of the above-described problems occurring in the related art, and the present disclosure proposes a hydraulic control system for preventing a hydraulic working device from experiencing hunting oscillations, or abruptly shaking, in a low-temperature environment. When discharge pressure abruptly surges in such a low-temperature environment, a hydraulic controller performing constant horsepower control by changing displacement of the variable displacement hydraulic pump issues a control signal for controlling the variable displacement hydraulic pump in which a control pressure may be recognized as having a lowest recognition pressure value. This can consequently prevent resonance of the discharge pressure of the variable displacement hydraulic pump, thereby preventing the hydraulic working device from experiencing hunting oscillations, or abruptly shaking.

According to an aspect of the present disclosure, a hydraulic control system may include: a flow control valve; a variable displacement hydraulic pump connected to the flow control valve to discharge pressurized fluid toward the flow control valve; a pump discharge pressure detector disposed on a passage between the flow control valve and the variable displacement hydraulic pump, the pump discharge pressure detector detecting a discharge pressure of the pressurized fluid discharged toward the flow control valve by the variable displacement hydraulic pump; and a hydraulic controller. The hydraulic controller includes: a detector connected to the pump discharge pressure detector to convert the detected discharge pressure to a pump discharge pressure value; a comparator receiving the pump discharge pressure value from the detector, comparing the pump discharge pressure value with a pre-stored lowest recognition pressure value, and determining whether the pump discharge pressure value is higher or lower than the pre-stored lowest recognition pressure value; and a calculator cooperating with the comparator to calculate a control pressure which the variable displacement hydraulic pump is controlled based on, wherein, when the pump discharge pressure value is lower than the lowest recognition pressure value, the calculator recognizes the control pressure as having the lowest recognition pressure value.

The hydraulic control system may further include a control lever connected to the flow control valve to control opening and closing the flow control valve.

The hydraulic control system may further include a pressure sensor detecting a pilot pressure applied to the flow control valve by the control lever.

The hydraulic control system may further include an engine working in concert with the variable displacement hydraulic pump to drive the variable displacement hydraulic pump.

The hydraulic control system may further include an electro-proportional pressure reducing valve connected to the variable displacement hydraulic pump to change pump displacement of the variable displacement hydraulic pump according to opening and closing operations of the electro-proportional pressure reducing valve.

The calculator may receive a value of pilot pressure, calculate a pump displacement from the value of pilot pressure with reference to a pre-stored pilot pressure-pump displacement relationship, calculate a torque of the variable displacement hydraulic pump from the calculated pump displacement and the calculated control pressure and transmit a control signal to the electro-proportional pressure reducing valve such that the variable displacement hydraulic pump operates within a maximum allowable torque value.

The lowest recognition value may be set to be higher than a value at which the control signal otherwise vibrates when an abrupt change of the discharge pressure occurs.

When the pump discharge pressure value is greater than the lowest recognition pressure value, the calculator may recognize the control pressure as having the pump discharge pressure value.

According to an aspect of the present disclosure, when discharge pressure abruptly surges in a low-temperature environment, a hydraulic controller performing constant horsepower control by changing displacement of a variable displacement hydraulic pump issues a control signal for controlling the variable displacement hydraulic pump in which a control pressure may be recognized as having a lowest recognition pressure value. This can consequently prevent resonance of the discharge pressure of the variable displacement hydraulic pump, thereby preventing a hydraulic working device from experiencing hunting oscillations, or abruptly shaking.

DETAILED DESCRIPTION

Hereinafter, a hydraulic control system according to exemplary embodiments will be described in detail with reference to the accompanying drawings.

In the following disclosure, detailed descriptions of known functions and components incorporated herein will be omitted in the case in which the subject matter of the present disclosure may be rendered unclear by the inclusion thereof.

Figure 1:
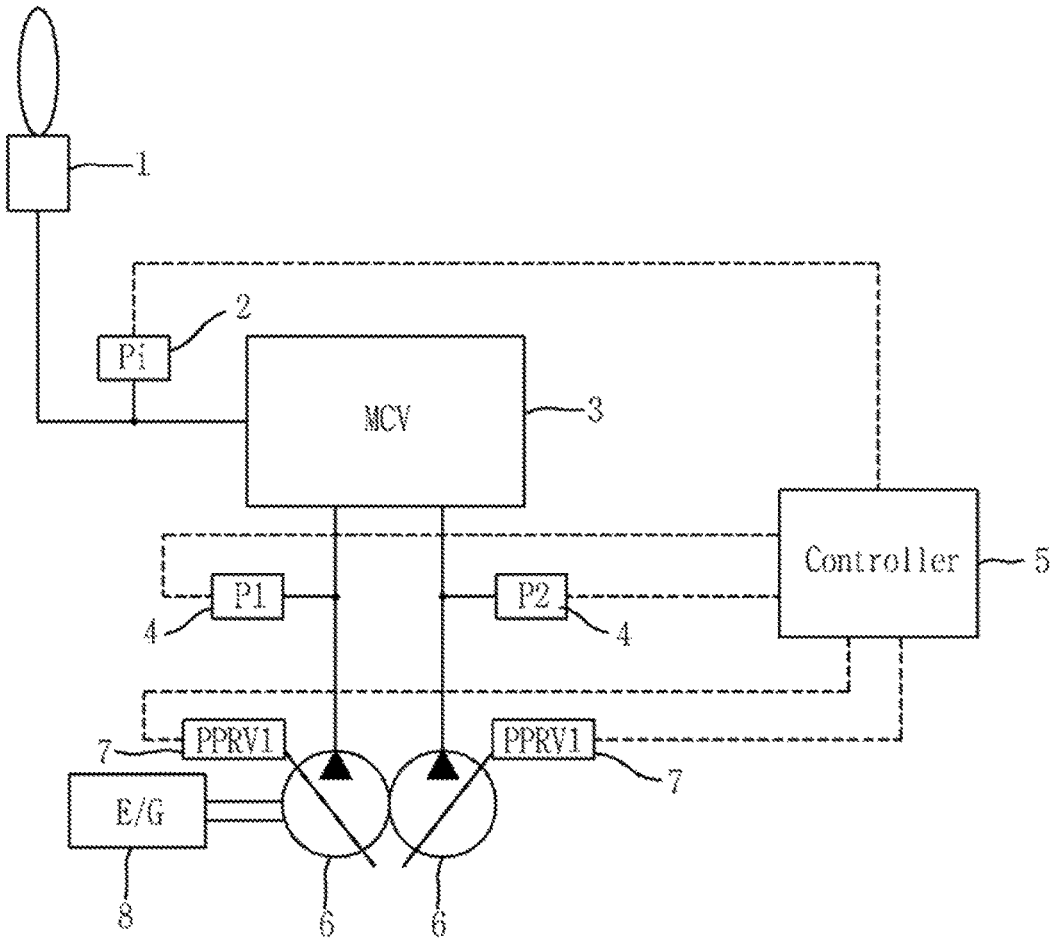
FIG. 1 is a block diagram illustrating a constant-horsepower control system.
Figure 2:
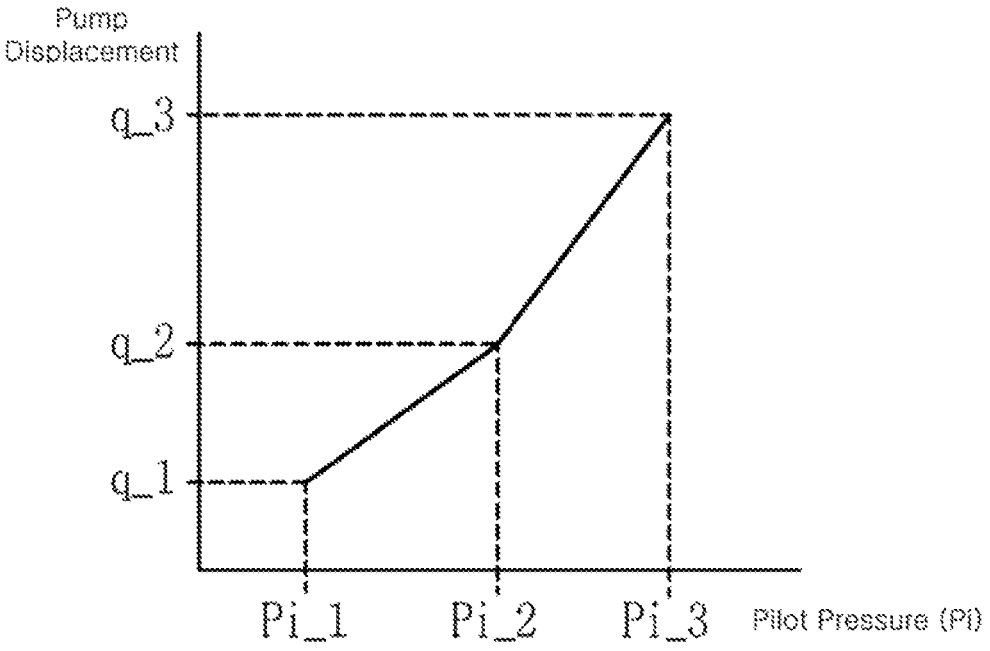
FIG. 2 is a curve graph illustrating a relationship between pump displacement and pilot pressure preset in a hydraulic controller illustrated in FIG. 1.
Figure 3:
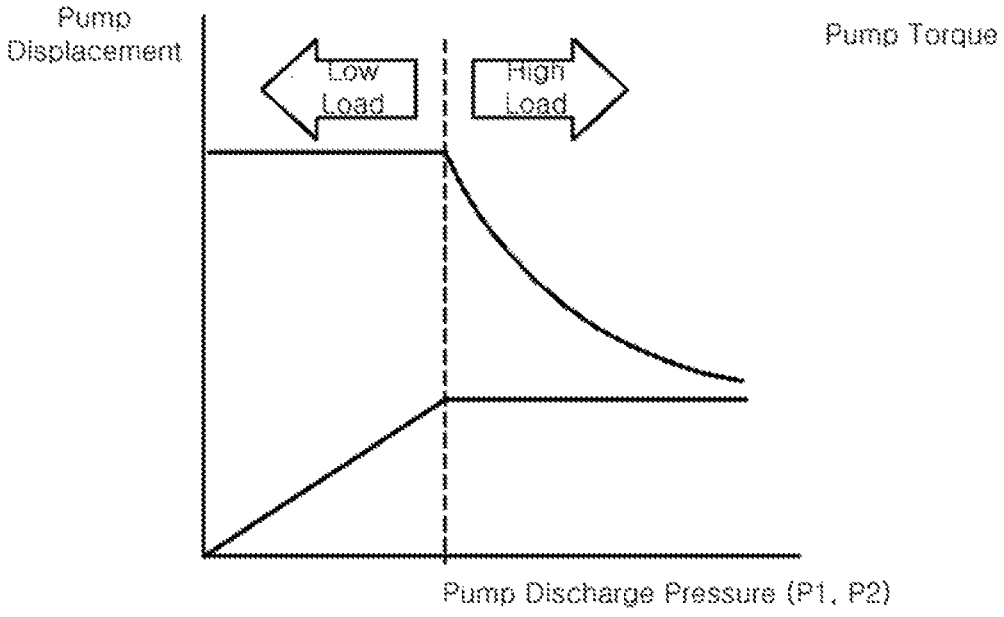
FIG. 3 is a pump constant torque curve preset in the hydraulic controller illustrated in FIG. 1, i.e. a graph depicting constant horsepower control through adjustment of the pump displacement and pump torque depending on discharge pressure of a variable displacement hydraulic pump.
Figure 4:
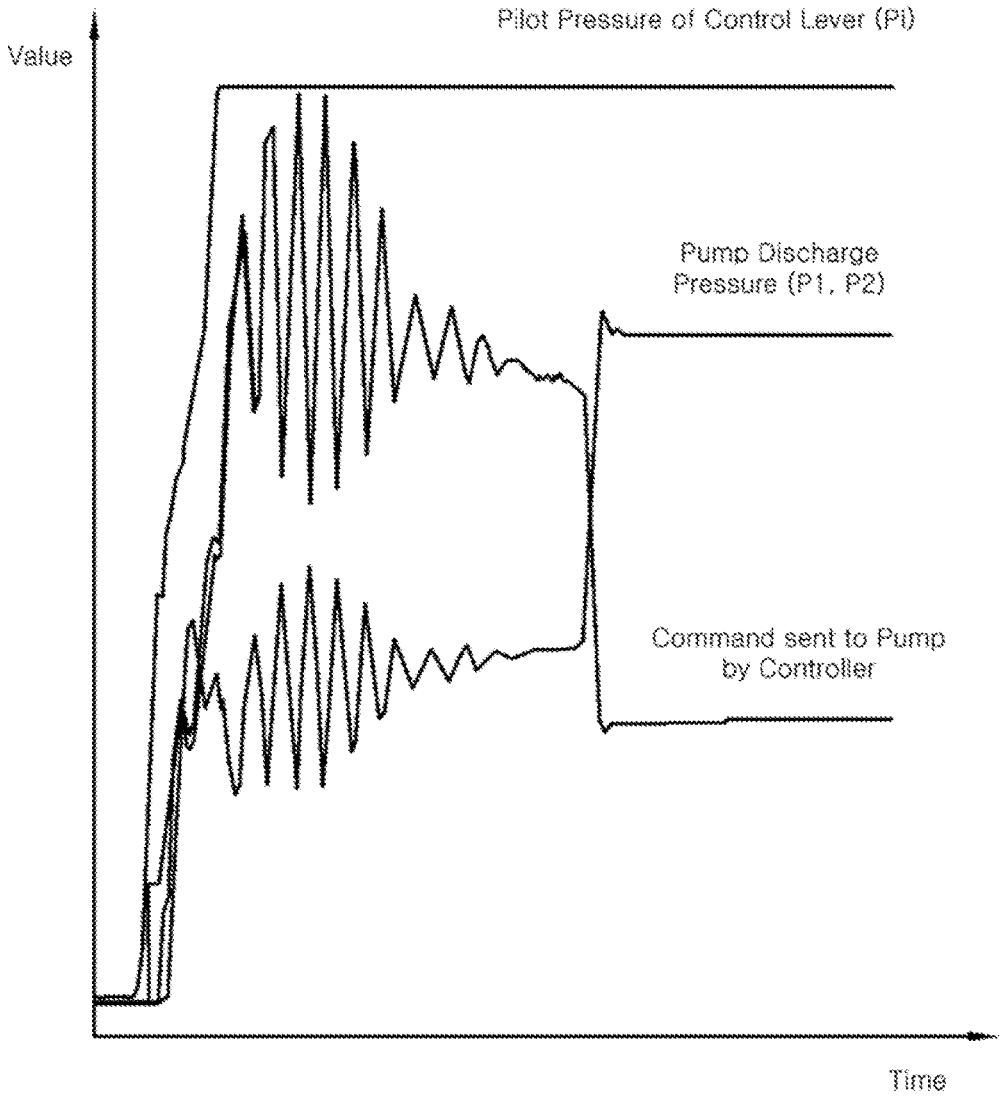
FIG. 4 is a graph illustrating the pilot pressure of the control lever, the discharge pressure of the variable displacement hydraulic pump, and a control signal by which the hydraulic controller instructs the variable displacement hydraulic pumps, plotted with time.
Figure 5:
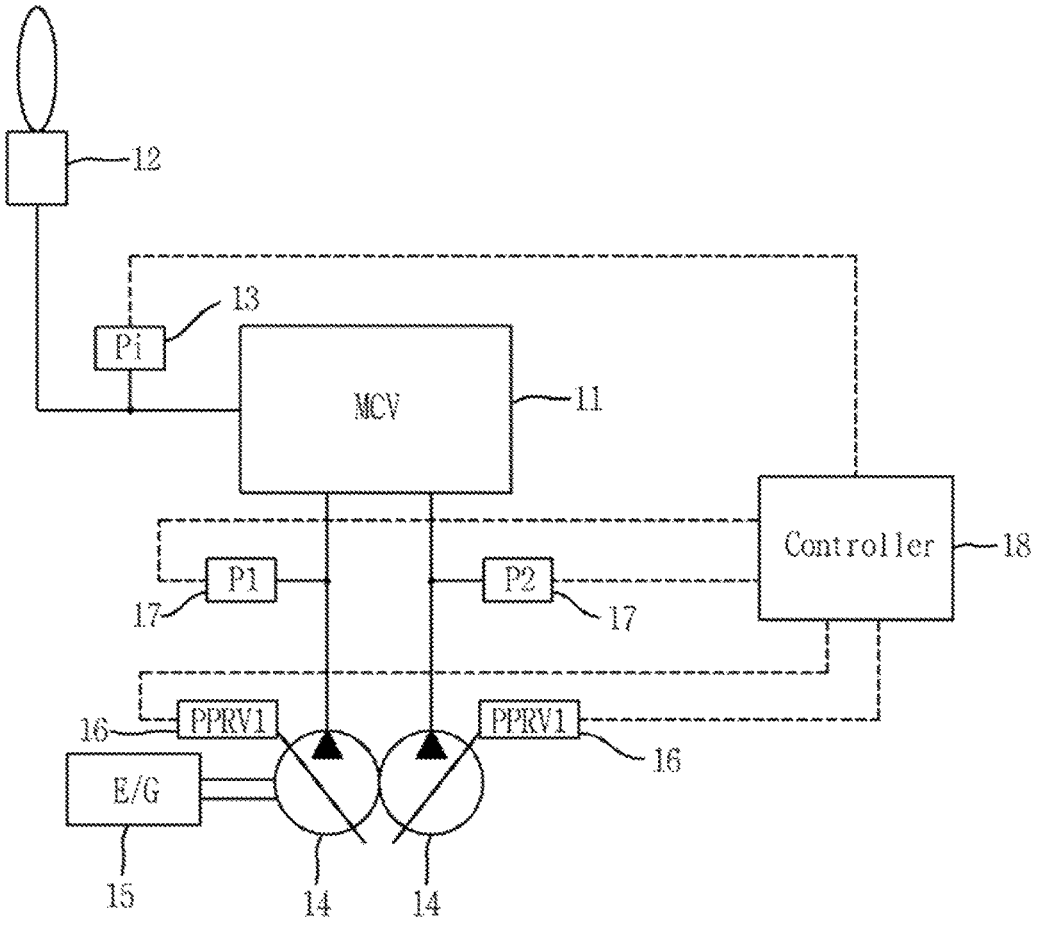
FIG. 5 is a hydraulic circuit diagram illustrating a hydraulic control system according to an exemplary embodiment.

As illustrated in FIG. 5, a hydraulic control system according to an exemplary embodiment may include a flow control valve 11, variable displacement hydraulic pumps 14, pump discharge pressure detectors 17, and a hydraulic controller 18. The hydraulic control system according to the exemplary embodiment may further include a control lever 12, a pressure sensor 13, an engine 15, and electro-proportional pressure reducing valves 16.

The flow control valve 1 may be a main control valve that controls actuators, such as hydraulic cylinders, provided for hydraulic working devices.

The control lever 12 may be connected to the flow control valve 11. The control lever 12 controls the opening and closing of the flow control valve 11 when manipulated by an operator, thereby controlling the actuators working in concert with the flow control valve 11.

The pressure sensor 13 is disposed on a passage between the control lever 12 and the flow control valve 11. The pressure sensor 13 may sense a pilot pressure in the passage between the control lever 12 and the hydraulic control valve 11 to generate an electrical signal proportional to the sensed pressure.

The variable displacement hydraulic pumps 14 may be connected to the flow control valve 11 and discharge hydraulic fluid toward the flow control valve 11. According to the exemplary embodiment, two variable displacement hydraulic pumps 14 are illustrated by way of example.

The engine 15 may work in concert with the variable displacement hydraulic pumps 14. The engine 15 may drive the variable displacement hydraulic pumps 14.

An electro-proportional pressure reducing valve 16 may be connected to variable displacement hydraulic pumps 14 to change displacement of the variable displacement hydraulic pumps 14, depending on the opening or closing thereof. According to the exemplary embodiment, the two electro-proportional pressure reducing valves 16 are illustrated as being provided for the two variable displacement hydraulic pumps 14, respectively.

The pump discharge pressure detectors 17 may be disposed on passages between the flow control valve 11 and the variable displacement hydraulic pumps 14. A pump discharge pressure detectors 17 may detect a discharge pressure of hydraulic fluid discharged toward the flow control valve 11 by the variable displacement hydraulic pump 14 to generate an electrical signal corresponding to the discharge pressure.

Figure 6:
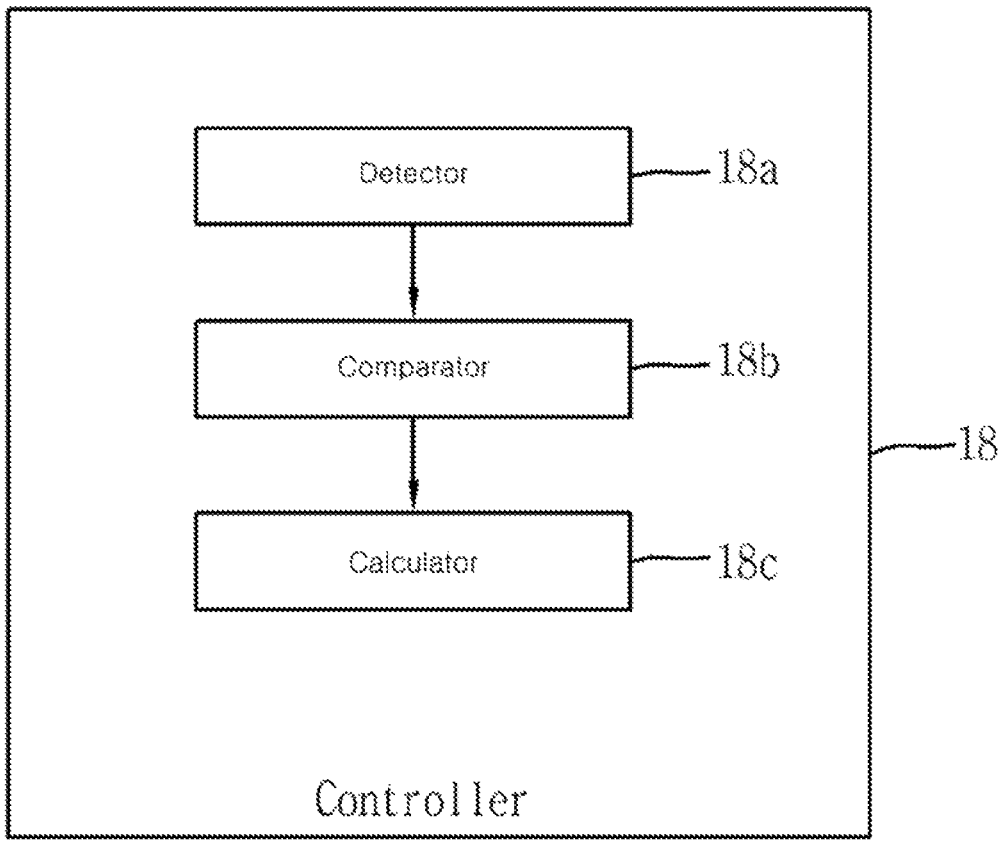
FIG. 6 is a block diagram of the hydraulic controller illustrated in FIG. 5.

The hydraulic controller 18 may be an industrial controller performing arithmetic operations on input values according to a control logic of a preset program. As illustrated in FIG. 6, the hydraulic controller 18 may include a detector 18*a*, a comparator 18*b*, and a calculator 18*c*, classified according to functions of the control logic.

The detector 18*a* may be connected to the pump discharge pressure detector 17. The detector 18*a* may convert the detected discharge pressure P1 or P2 into a pump discharge pressure value. In addition, the comparator 18*b* may receive the pump discharge pressure value input by the detector 18*a* and determine whether the pump discharge pressure value is higher or lower than a lowest recognition pressure value setDP by comparing the pump discharge pressure value with the lowest recognition pressure value setDP. The lowest recognition pressure value setDP may be set to be higher than a value at which a control signal transmitted to the electro-proportional pressure reducing valve 16 otherwise vibrates when an abrupt pressure change in discharge pressure occurs, such that the working device does not suffer from hunting oscillations in response to the abrupt pressure change at a low temperature. The calculator 18*c* cooperates with the comparator 18*b*. When the pump discharge pressure value is greater than the lowest recognition pressure value setDP, the calculator 18*c* calculates a control pressure which the variable displacement hydraulic pump 14 is controlled based on, by recognizing the pump discharge pressure value as the control pressure. When the pump discharge pressure value is lower than the lowest recognition pressure value setDP, the calculator 18*c* calculates the control pressure by recognizing the lowest recognition pressure value setDP as the control pressure. The calculator 18*c* may receive a pilot pressure from the pressure sensor 13, calculate a pump displacement from the pilot pressure with reference to a pre-stored pilot pressure-pump displacement relationship, as illustrated in FIG. 9, calculate a torque from the calculated pump displacement and the calculated control pressure and transmit a control signal to the electro-proportional pressure reducing valve 16 such that the variable displacement hydraulic pump operates within a maximum allowable torque value.

Hereinafter, a method of controlling pump displacements with the above-described hydraulic control system will be described in more detail.

Figure 9:
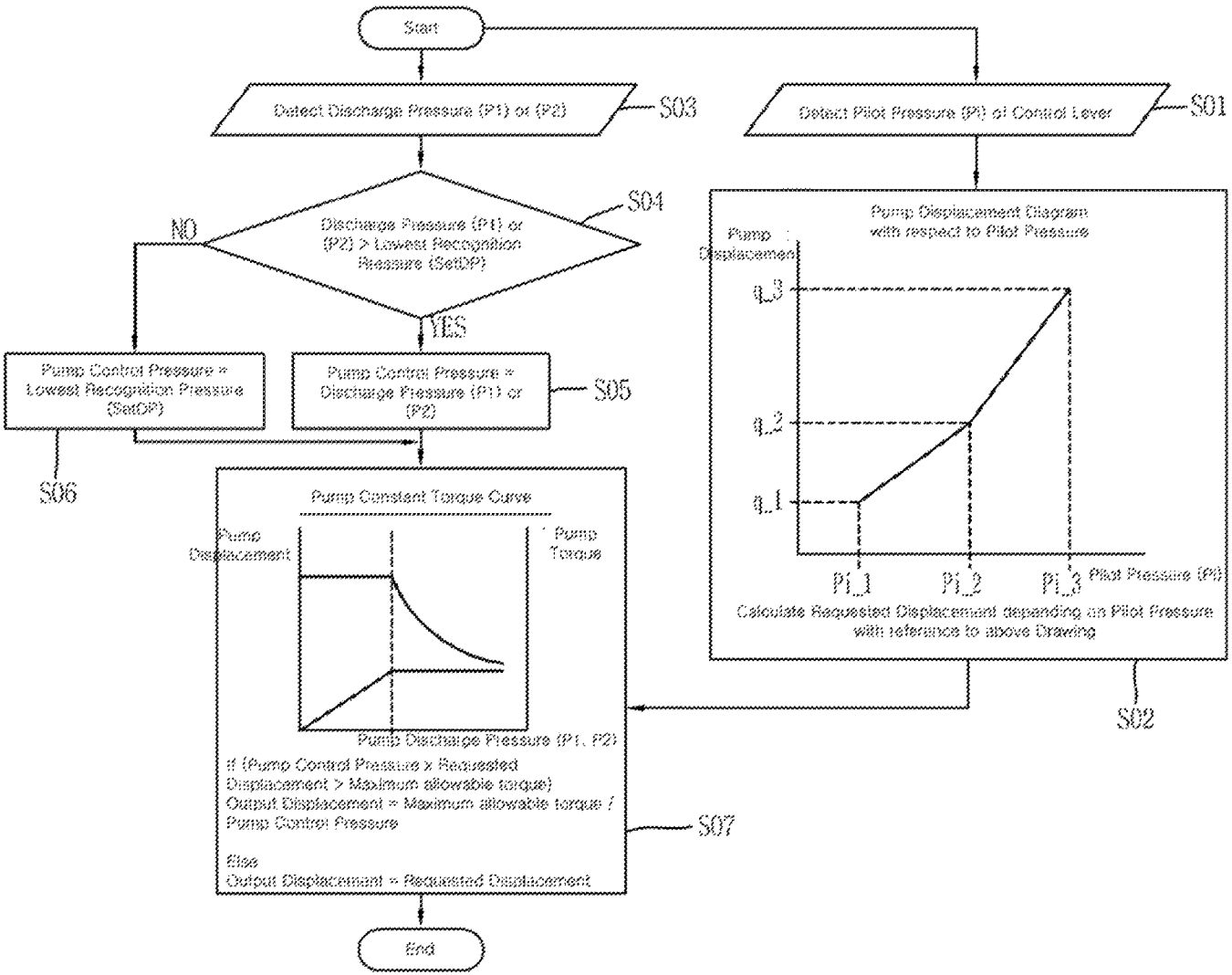
FIG. 9 is a flowchart illustrating an operation of calculating pump displacements using the hydraulic control system illustrating in FIG. 5.

As illustrated in FIG. 9, first, when an operator manipulates a control lever 12, the hydraulic control system periodically receives pilot pressure values from the pressure sensor 13 (S01) and then calculates requested displacements, based on the curve of pump displacement with respect to pilot pressure (S02).

The detector 18*a* of the hydraulic controller 18 periodically receives pump discharge pressure values from the pump discharge pressure detector 17 (S03) and transmits the received pump discharge pressure values to the comparator 18*b*. The comparator 18*b* receives the pump discharge pressure values from the detector 18*a*, compares the pump discharge pressure values with the pre-stored lowest recognition pressure value setDP and determines whether the pump discharge pressure values are higher or lower than the lowest recognition pressure value setDP (S04), and then delivers comparison results to the calculator 18*c*.

Afterwards, when a pump discharge pressure value is greater than the lowest recognition pressure value setDP, the calculator 18*c* calculates the control pressure by recognizing the control pressure which the variable displacement hydraulic pump 14 is controlled based on, as the pump discharge pressure value, through cooperating with the comparator 18*c* (S05). When the pump discharge pressure value is lower than the lowest recognition pressure value setDP, the calculator 18*c* calculates the control pressure by recognizing the control pressure which the variable displacement hydraulic pump 14 is controlled based on, as the lowest recognition pressure value setDP, through cooperating with the comparator 18*c* (S06).

After calculating the control pressure to be either the actual pump discharge pressure value or the lowest recognition pressure value setDP as described above, the calculator 18*c* calculates a torque using the calculated control pressure. The calculator 18*c* then transmits a control signal to the electro-proportional pressure reducing valve 16, the control signal allowing a displacement of the variable displacement hydraulic pumps 14 to be adjusted based on the pump displacement curve with respect to pilot pressures, as long as the variable displacement pump operates within a maximum allowable torque value (S07).

Figure 7:
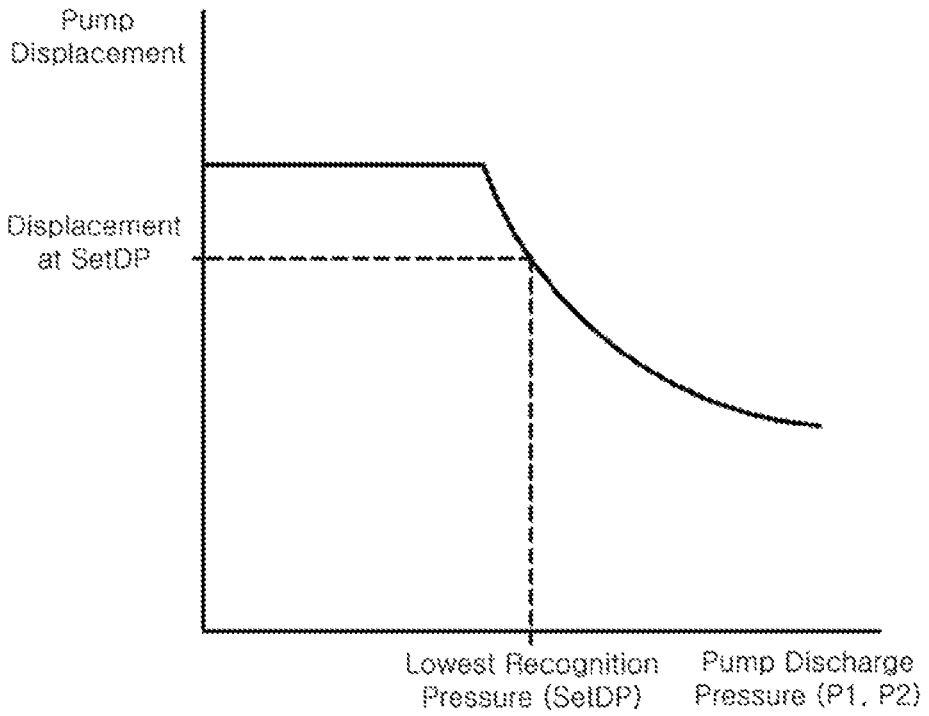
FIG. 7 is a pump constant torque curve pre-stored in the hydraulic controller illustrated in FIG. 5.
Figure 8:
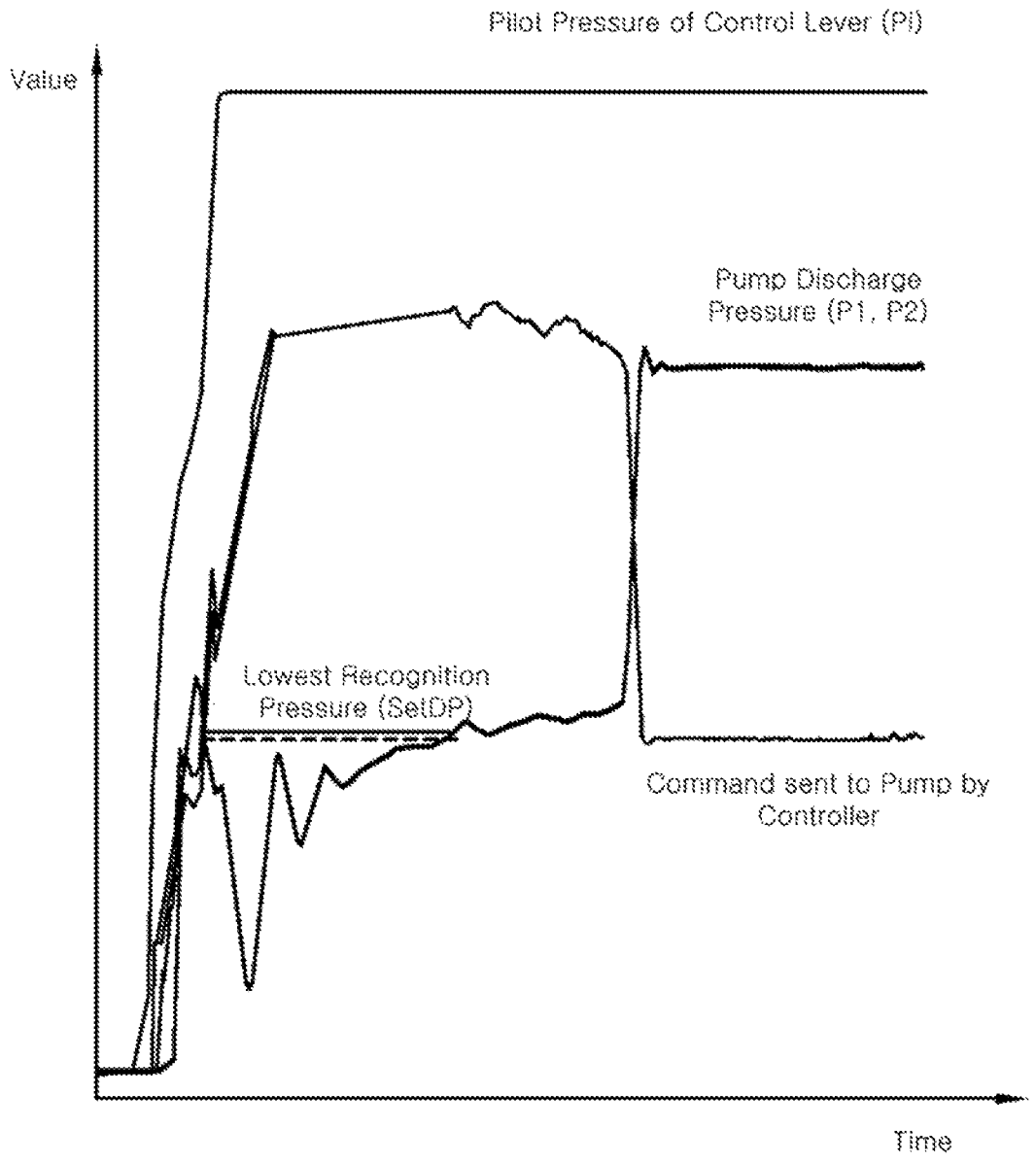
FIG. 8 is a graph illustrating pilot pressure of the control lever illustrated in FIG. 5, discharge pressure of the variable displacement hydraulic pump illustrated in FIG. 5, and a control signal by which the hydraulic controller instructs the variable displacement hydraulic pump, plotted with time.

According to the control method as described above, the hydraulic control system according to the exemplary embodiment prevents the hydraulic working devices from experiencing hunting oscillations, or abruptly shaking, in a low-temperature environment. Specifically, when discharge pressure abruptly surges in such a low-temperature environment, the hydraulic controller 18 performing constant horsepower control by changing displacement of the variable displacement hydraulic pump 14, as illustrated in FIG. 7 issues a control signal for controlling the variable displacement hydraulic pump 14, as illustrated in FIG. 8, in which a control pressure may be recognized as having a lowest recognition pressure value setDP. This can consequently prevent resonance of the discharge pressure of the variable displacement hydraulic pump 14, thereby preventing the hydraulic working device from experiencing hunting oscillations, or abruptly shaking.

The foregoing descriptions of specific exemplary embodiments of the present disclosure have been presented with respect to the drawings. They are not intended to be exhaustive or to limit the present disclosure to the precise forms disclosed, and obviously many modifications and variations are possible for a person having ordinary skill in the art in light of the above teachings.

It is intended therefore that the scope of the present disclosure not be limited to the foregoing embodiments, but be defined by the Claims appended hereto and their equivalents.

The invention claimed is:

1. A hydraulic control system comprising:

a flow control valve;

a variable displacement hydraulic pump connected to the flow control valve to discharge pressurized fluid toward the flow control valve;

a pump discharge pressure detector disposed on a passage between the flow control valve and the variable displacement hydraulic pump, the pump discharge pressure detector detecting a discharge pressure of the pressurized fluid discharged toward the flow control valve by the variable displacement hydraulic pump; and a hydraulic controller comprising:

a detector connected to the pump discharge pressure detector to convert the detected discharge pressure to a pump discharge pressure value, a comparator receiving the pump discharge pressure value from the detector, comparing the pump discharge pressure value with a pre-stored lowest recognition pressure value, and determining whether the pump discharge pressure value is higher or lower than the pre-stored lowest recognition pressure value, a calculator cooperating with the comparator to calculate a control pressure which the variable displacement hydraulic pump is controlled based on, wherein, when the pump discharge pressure value is lower than the pre-stored lowest recognition pressure value, the calculator recognizes the control pressure as having the pre-stored lowest recognition pressure value, and an electro-proportional pressure reducing valve connected to the variable displacement hydraulic pump to change pump displacement of the variable displacement hydraulic pump according to opening and closing operations of the electro-proportional pressure reducing valve, wherein the calculator receives a value of pilot pressure, calculates a pump displacement from the value of pilot pressure with reference to a pre-stored pilot pressure-pump displacement relationship, calculates a torque of the variable displacement hydraulic pump from the calculated pump displacement and the calculated control pressure, and transmits a control signal to the electro-proportional pressure reducing valve such that the variable displacement hydraulic pump operates within a maximum allowable torque value.

2. The hydraulic control system of claim 1, further comprising a control lever connected to the flow control valve to control opening and closing the flow control valve.

3. The hydraulic control system of claim 2, further comprising a pressure sensor detecting a pilot pressure applied to the flow control valve by the control lever.

4. The hydraulic control system of claim 1, further comprising an engine working in concert with the variable displacement hydraulic pump to drive the variable displacement hydraulic pump.

5. The hydraulic control system of claim 1, wherein the lowest recognition value is set to be higher than a value at which the control signal otherwise vibrates when an abrupt change of the discharge pressure occurs.

6. The hydraulic control system of claim 1, wherein, when the pump discharge pressure value is greater than the lowest recognition pressure value, the calculator recognizes the control pressure as having the pump discharge pressure value.

* * * * *